US006182590B1

(12) United States Patent
Patera

(10) Patent No.: US 6,182,590 B1
(45) Date of Patent: Feb. 6, 2001

(54) PERSONAL WATERCRAFT SUSPENSION SYSTEM

(76) Inventor: John M. Patera, 6155 Lance Rd., Medina, OH (US) 44256

( * ) Notice: Under 35 U.S.C. 154(b), the term of this patent shall be extended for 0 days.

(21) Appl. No.: 09/443,802

(22) Filed: Nov. 19, 1999

Related U.S. Application Data

(60) Provisional application No. 60/109,835, filed on Nov. 25, 1998.

(51) Int. Cl.[7] ..... B63B 29/00

(52) U.S. Cl. ..... 114/55.57; 114/363

(58) Field of Search ..... 114/363, 55.55, 114/55.57

(56) References Cited

U.S. PATENT DOCUMENTS

| | | | |
|---|---|---|---|
| 2,787,315 | 2/1957 | Siebert . | |
| 3,186,674 | 6/1965 | O'Link | 248/399 |
| 3,427,038 | 2/1969 | Gauss | 280/6 |
| 4,909,177 | 3/1990 | Jones | 114/353 |
| 5,309,861 | 5/1994 | Mardikian | 114/363 |
| 5,353,734 * | 10/1994 | Tani | 114/363 |
| 5,367,978 * | 11/1994 | Mardikian | 114/363 |
| 5,465,679 | 11/1995 | Mardikian | 114/363 |
| 5,542,371 | 8/1996 | Harvey, Renaud, Gagnon | 114/363 |
| 5,603,281 | 2/1997 | Harvey, Renaud, Gagnon | 114/363 |

FOREIGN PATENT DOCUMENTS 10-129581 * 5/1998 (JP) .

* cited by examiner

*Primary Examiner*—Sherman Basinger

(57) ABSTRACT

A suspension system for personal water craft. The personal water craft suspension system includes a gas-inflated bladder (10) that is adapted for placement between a hull and seat of a personal water craft. The suspension system further includes at least one telescopic connector between the seat and the hull. For the typical personal water craft, the suspension system includes a back seat telescopic latch stud (18) and a front seat telescopic U hook(40). These telescopic connectors enable the seat to move up and down with respect to the hull with the bladder sandwiched between the seat and hull. The suspension system is operative to absorb or dampen the effects of bumps and other forces acting on personal water craft when a user is seated on the personal water craft and is riding over rough water.

18 Claims, 3 Drawing Sheets

PERSONAL WATERCRAFT SUSPENSION SYSTEM

This application claims the benefit of U.S. Provisional Ser. No. 60/109,835 filed Nov. 25, 1998.

TECHNICAL FIELD

This invention relates to a personal water craft suspension system. Specifically this invention relates to a new suspension system for new and preexisting personal water craft that provides increased comfort for the user.

BACKGROUND ART

Personal water craft use has become a very popular sport. Examples of a personal water craft (PWC) include water jet propelled crafts such as the JetSki® and Waverunner®. However for purposes of the present invention a PWC applies to any low profile water craft. Unfortunately riders of personal water craft often experience rough, and uncomfortable rides. As the personal water craft moves over high waves or choppy water, the rider when seated often bounces up and down on the seat, which puts stress on the body of the rider. Many riders learn to reduce the uncomfortable effects caused by rough waters by standing with each leg bent at the knee. When the personal water craft moves up or down the rider can bend or flex his legs to absorb some of the resulting shock.

Several systems have been devised for user comfort; however, each has one or more significant drawbacks. One such system, shown in U.S. Pat. No. 5,603,281 (1997), shows a personal water craft reconstructed in a new design to implement an effective shock absorber. The disadvantages of this suspension system are adapting it to existing and newly manufactured personal water craft without a suspension design. This suspension is complex, not adjustable and is an expensive feature.

Siebert in U.S. Pat. No. 2,787,315 (1954), shows a spring seat for outboard boats. The spring seat of Seibert is not designed to mount to a personal water craft.

Gauss, in U.S. Pat. No. 3,427,038 (1969), shows a complex suspension system designed for the entire floor of a boat to move. This system is designed for large boats and thus shares the same disadvantage as that of Siebert's.

O'Link in U.S. Pat. No. 3,186,674 (1965), shows an improvement in a suspension system for a boat seat. This system is not designed to mount to personal water craft and thus shares the disadvantage of Siebert's.

Mardikinian in U.S. Pat. No. 5,309,861 (1994), shows a personal water craft reconstructed in a new design to implement an effective shock absorber. It is similar to U.S. Pat. No. 5,603,281 (1997) and thus shares the same disadvantages.

Jones in U.S. Pat. No. 4,909,177 (1990), shows an inflatable boat seat to mount to the interior of an inflatable boat. One disadvantages of this seat is that it is not easily adaptable to a personal water craft.

Harvey, Renaud, Gagnon, Rondeau, LaPointe in U.S. Pat. No. 5,542,371 (1996), shows a more complex version of U.S. Pat. No. 5,603,281 (1997) and which shares the same disadvantages.

Mardikinian in U.S. Pat. No. 5,465,679 (1995), shows a suspension system in which the floorboards of a personal water craft absorb the shock. One disadvantage of this system is that it would only be effective if the user is in a standing position; hence, it does not provide increased comfort to the rider when seated.

Consequently, there exists a need for an effective shock absorbing system which will significantly increase the level of comfort of a seated rider of a personal water craft.

DISCLOSURE OF INVENTION

It is an object of the present invention to provide a suspension system for personal water craft.

It is a further object of the present invention to provide a suspension system for personal water craft that provides a safe, smooth, and stable ride.

It is a further object of the present invention to provide a suspension system for personal water craft that enables a more comfortable ride for seated users.

It is a further object of the present invention to provide a suspension system for personal water craft that reduces the stress on the seated user when riding over choppy waters.

It is a further object of the present invention to provide a suspension system for personal water craft that can be mounted to preexisting personal water craft.

It is a further object of the present invention to provide a suspension system for personal water craft that can be made relatively economically.

It is a further object of the present invention to provide a suspension system for personal water craft that enables a seat to move up and down with respect to a hull of the personal water craft.

It is a further object of the present invention to provide a suspension system for personal water craft that is operative to prevent water from passing into the hull from between the seat and the hull.

It is a further object of the present invention to provide a suspension system for personal water craft that is adjustable to allow several levels of suspension.

Further objects of the present invention will be made apparent in the following Best Modes for Carrying Out Invention and the appended claims.

The foregoing objects are accomplished in one exemplary embodiment of the invention by a suspension system that comprises a bladder having a rubber body that is gas inflated. The bladder has a shape that is adapted for being sandwiched between the personal water craft (PWC) hull and seat. The suspension system further includes a telescoping latch stud and telescoping U hook that releaseably connects the seat to the hull. These telescopic connectors enable the seat to move up and down with respect to the hull with the bladder positioned between the seat and the hull.

When the PWC is ridden over rough water, the bladder and telescoping latch stud and U hook expand and contract responsive to movement of the seat. As the seat moves the bladder maintains a water tight seal between the seat and the hull for preventing water from entering the PWC. The resulting bladder is operative to dampen the effects of bumps and shock forces acting on the PWC, resulting in a suspension system provides increased comfort, safety, and stability to riders.

The exemplary embodiments of the bladder and telescopic connectors are designed to mount to existing PWC's. The exemplary telescopic latch stud is operative to replace a standard stock back fixed latch stud. The exemplary telescopic U hook is operative to replace a standard stock front fixed U hook. In alternative embodiments, the exemplary telescopic connectors may also be configured for other body styles, seats and hulls.

The exemplary bladder is operative to be sandwiched between a stock seat and stock hull of many models of PWC's. In other exemplary embodiments the bladder can have other shapes depending on the PWC body style. The bladder may also be thicker or taller for heavy duty riding or racing. In addition by inflating the bladder with different levels of internal gas pressure, the suspension system of the present invention can be configured for different levels of comfort and performance.

In alternative embodiments of the present invention new PWC's can be adapted to include the elements of the present invention as stock suspension components.

BEST MODES FOR CARRYING OUT INVENTION

Figure 1:
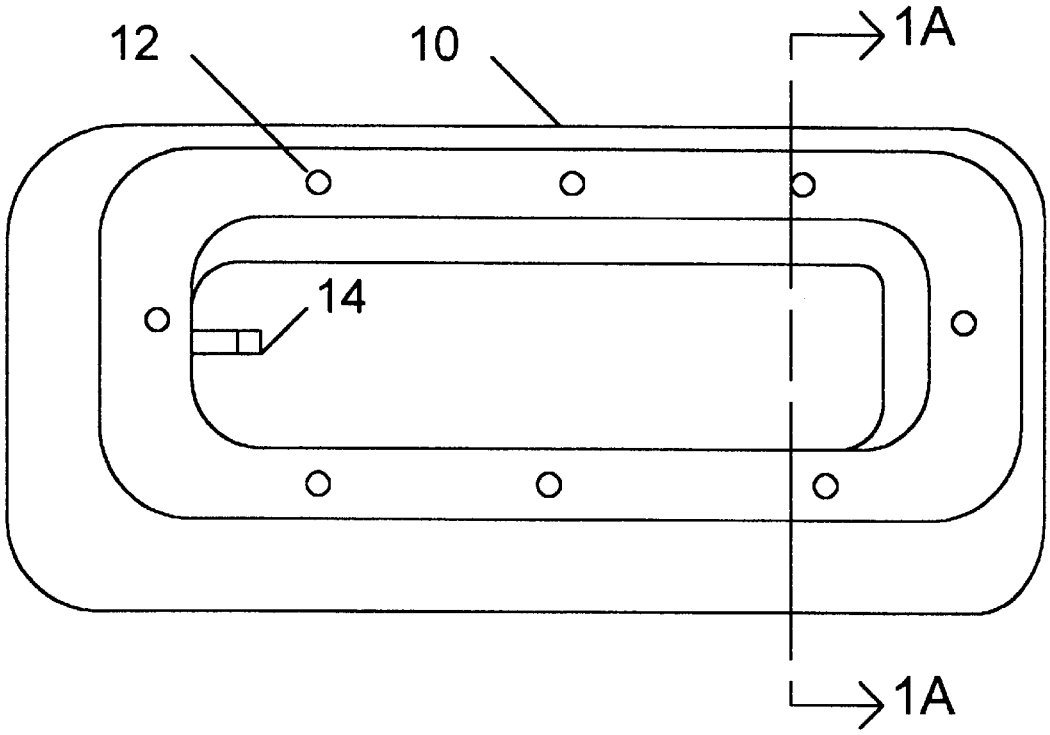
FIG. 1 is representative of a perspective view of an exemplary gas filled bladder suspension element of the present invention.

Referring now to the drawings and particularly to FIG. 1, there is shown therein, a schematic view representative of an exemplary embodiment of a bladder 10 of the present invention. The bladder 10 is comprised of a molded flexible water resistant material such as a synthetic rubber. The bladder 10 includes a valve stem 14 molded into the bladder which enables the bladder to be inflated with inexpensive gases such as air. In addition the valve stem enables the internal pressure of the bladder to be easily adjusted depending on the desired suspension characteristics of the rider.

The bladder 10 includes a shape that is adapted for placement between the hull and seat of a PWC. The bladder is operative to compress and expand responsive to forces acting between the hull and seat. This enables the bladder to dampen the effects of bumps and other shocks or vibrations by allowing the seat to move up and down with respect to the hull.

Mounting holes 12 are clearance holed molded into the bladder to enable the bladder to be permanently fastened to the underside of the PWC seat if desired. In such embodiments the bladder 10 may be permanently attached to the seat with rivets, glue or any other operative connecting means.

Figure 1A:
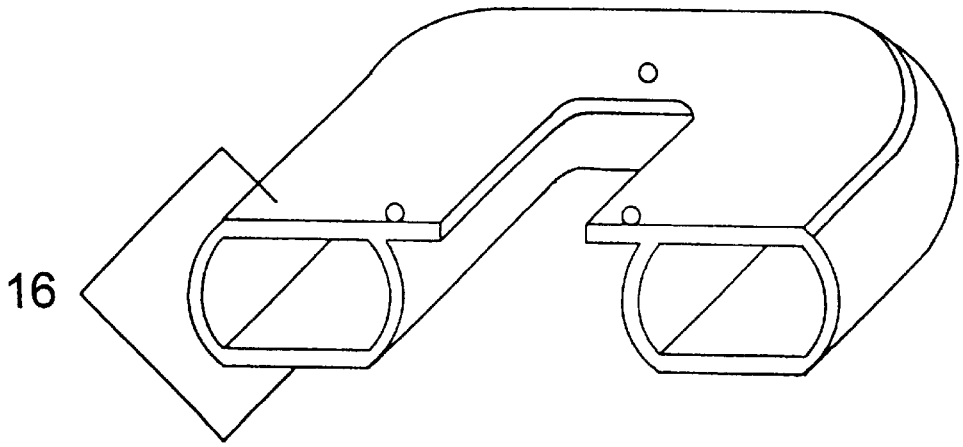
FIG. 1A is representative of a cross sectional view of the exemplary gas filled bladder suspension element of the present invention.

As shown in FIG. 1A, the bladder includes top and bottom gasket surfaces 16 that have a shape and contour which corresponds to the opposing surfaces of the seat and the hull. The gasket surfaces are operative to prevent water from entering the PWC from between the seat and hull. Although the exemplary embodiment is shown with relatively flat gasket surfaces, alternative embodiments of the bladder may include any shape which is operative to create a water tight seal between with both the seat and the hull.

Figure 2:
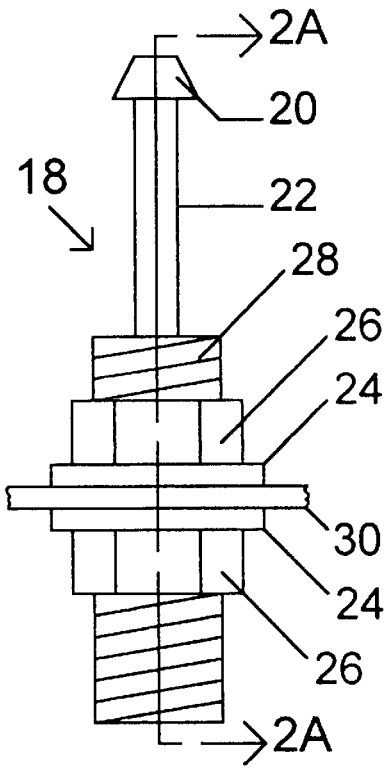
FIG. 2 is representative of a plan side view of an exemplary telescoping stabilizer latch stud of the present invention.
Figure 3:
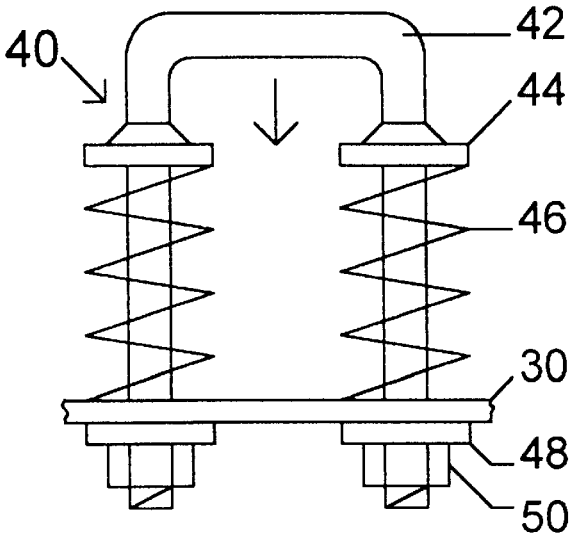
FIG. 3 is representative of a plan side view of an exemplary telescoping stabilizer latch U hook of the present invention.

FIGS. 2 and 3 show exemplary views of telescopic connectors 18 and 40 that are operative to releaseably mount the seat to the hull of a PWC when the bladder is positioned between the seat and the hull. These telescopic connectors enable the seat to move up and down with respect to the hull while keeping pressure on the gasket surface of the bladder for maintaining the watertight seal between the seat and hull.

Figure 2A:
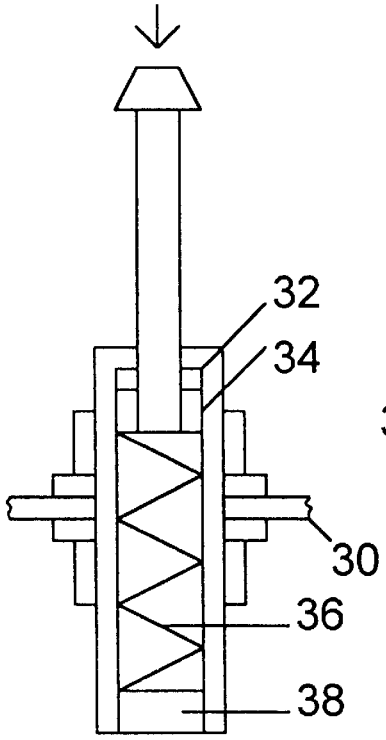
FIG. 2A is representative of a cross section side view of the exemplary telescoping stabilizer latch stud element of the present invention.
Figure 2B:
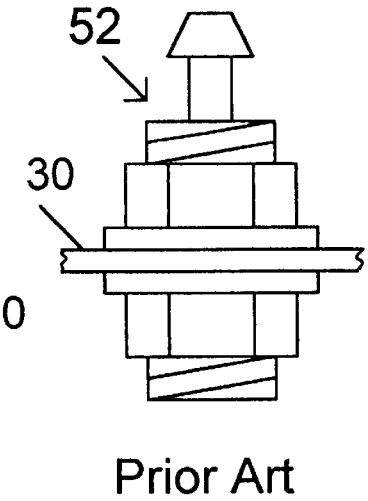
FIG. 2B is representative of a plan side view of an original stock fixed stabilizer latch stud which connect the back portion of a PWC seat to the hull.

The telescopic latch connector 18 shown in FIG. 2 is operative to replace a standard stock prior art fixed latch mounting stud 52 which is shown in FIG. 2B. This described telescoping latch connector 18 includes a shaft 22 with integral locking head 20. As shown in FIG. 2A, the shaft is in operative connection with a piston head 34 that is operative to reciprocate within a cylinder body 28. The cylinder body includes a compression spring 36 between the piston head 34 and a retaining plug 38. The compression spring 36 is operative to bias the piston head 34 in a direction that moves the shaft 22 to an extended or expanded position for latching the locking head 20 to the seat of the PWC. The cylinder body 28 includes a washer 32 between the piston head 34 and cylinder body 28. The washer 32 is operative to minimize water entering the cylinder body and further acts as a sound buffer when the piston 34 taps the end of the cylinder body 28.

The telescopic latch connector 18 replaces an original stock fixed latch stud 52 by sliding through the original stock hole in the personal water craft fiberglass hull 30. The cylinder body 28 is threaded to receive locking nuts 26 for mounting the telescopic connector in the hull 30. The locking nuts 26 along with washers 24 enable the telescoping latch stud 18 to be adjustably positioned on the PWC hull 30 for providing the required amount of gasket pressure for the bladder.

Figure 3A:
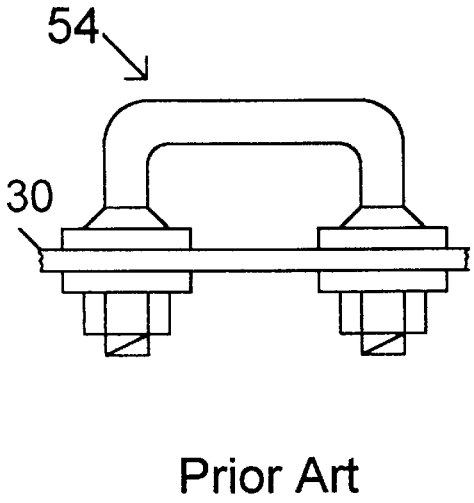
FIG. 3A is representative of a plan side view of an original stock fixed stabilizer U latch hook for connecting the front portion of a PWC seat to the hull.

FIG. 3 shows an exemplary telescopic U hook connector 40 that is operative to replace a stock fixed front U hook 54 as shown in FIG. 3A. This described telescopic U hook 40 includes a U bolt 42 with integral stop washers 44. Each side of the threaded U bolt 42 includes the compression spring 46 under the welded stop washers 44. The stop washers 44 are weld fastened to the threaded U bolt 42 and act as a stopper for the compression springs 46. The threaded U bolt 42 replaces the original stock fixed U bolt 54 shown in FIG. 3A by sliding through the original stock holes in the personal water craft fiberglass hull 30. Both ends of the threaded U bolt 40 include washers 48 which are sandwiched between the hull and locking nuts 50. Washers 48 are operative to absorb sound and impact of the up and down movement in the telescoping U hook 40.

It is to be understood that the described telescopic connectors are representative of one exemplary embodiment of the present invention. Other embodiments may include alternative telescopic configurations to correspond to the latching mechanisms required for other hull and seat designs. In addition all elements that comprise this invention are preferable non-corrosive, water and U.V. resistant.

Figure 4:
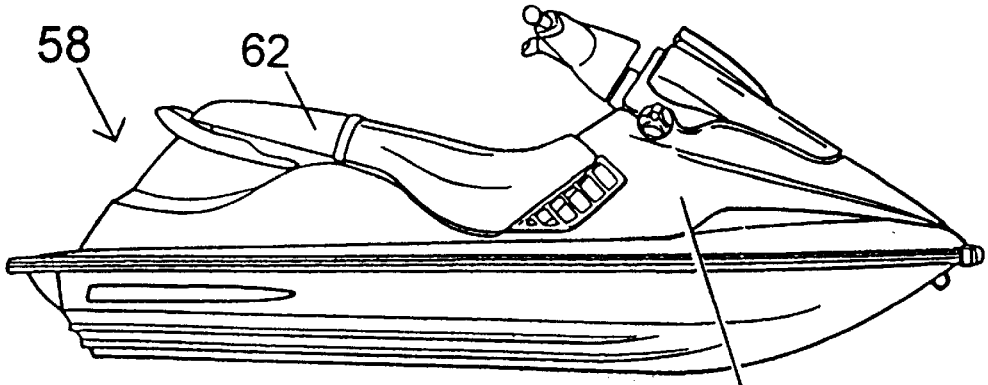
Prior Art Figure 4
FIG. 4 is a perspective view of a normal stock personal water craft (PWC).
Figure 5:
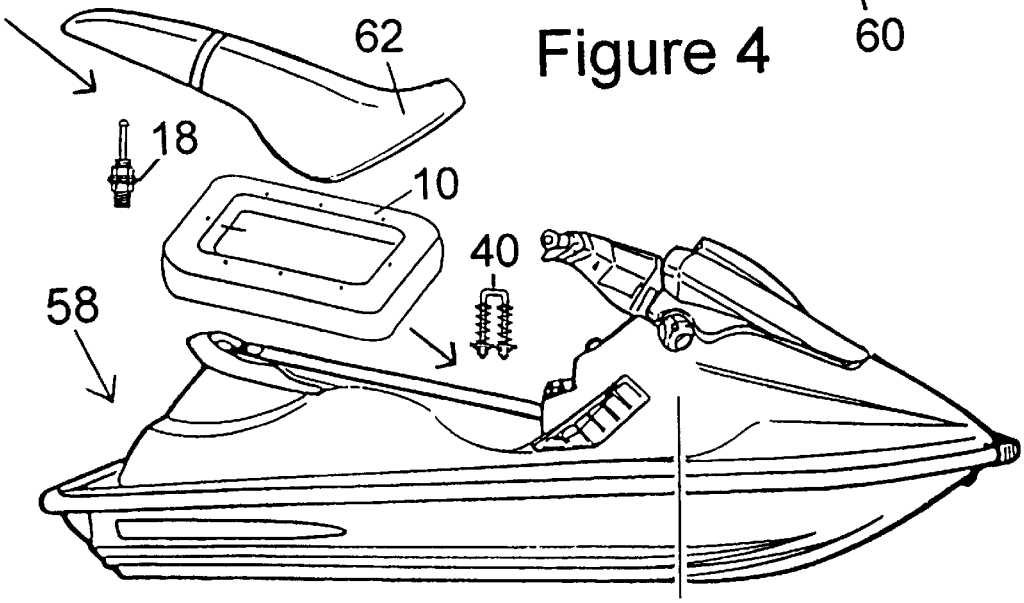
FIG. 5 is a perspective view of an exemplary embodiment of the personal water craft suspension system being installed on a normal PWC.
Figure 6:
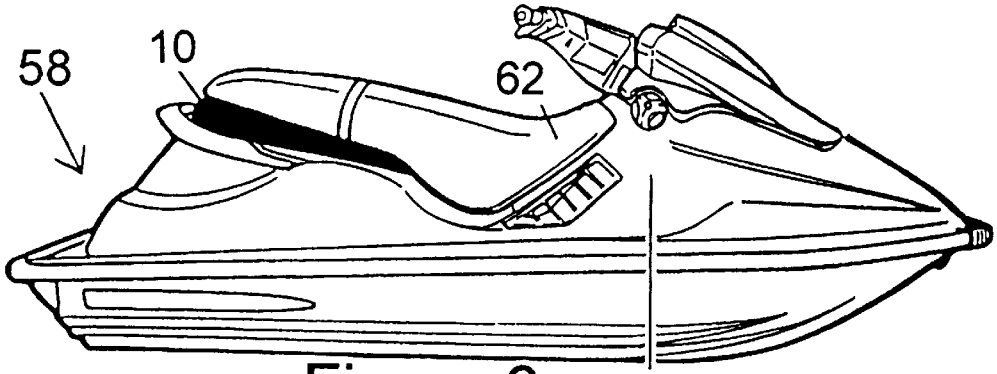
FIG. 6 is a perspective view of the exemplary embodiment of the personal water craft suspension system installed on a PWC.

FIGS. 4–6 show a stock PWC 58 that is being retrofitted with the suspension system of the present invention. FIG. 4 is representative of the stock PWC 58 with hull 60 and seat 62. FIG. 5 shows the relative locations for installing the telescopic latch connector 18, bladder 10, and telescopic U hook 40 in the PWC 58. FIG. 6 shows the PWC with the suspension system installed. Although not visible in this view, the telescopic latch connector and telescopic U hook are operative to releaseably mount the seat 62 to the hull 60 with the bladder 10 sandwiched between the hull 60 and seat 62.

Accordingly, it can be seen that the personal water craft suspension system of the present invention can be installed on new and existing PWC easily, economically, and without altering the PWC body. The suspension can also be adjusted at several different levels for the comfort of PWC users by changing the internal gas pressure of the bladder. The resulting suspension system of the present invention is operative to absorb some of the impact on the hull and seat caused by waves and other forces for providing a smooth, stable, comfortable and more enjoyable PWC ride. In addition the present invention is operative to reduce stress cracks in the hull and to increase the overall safety of the rider by providing the user with greater control of steering and throttle.

Thus the personal water craft suspension system achieves the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the structures shown herein or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. A personal water craft suspension system comprising:

a bladder, wherein the bladder has a shape that is adapted for placement between a seat and a hull of a personal water craft, wherein the bladder is operative to prevent water from entering the personal water craft between the seat and the hull; and a telescopic connector, wherein the telescopic connector is operative to releaseably connect the seat to the hull with the bladder positioned between the seat and the hull, wherein the telescopic connector and the bladder are operative to move between an expanded position and a compressed position responsive to forces acting on the seat and the hull.

2. A personal water craft suspension system according to claim 1, wherein the telescopic connector is biased to the expanded position.

3. A personal water craft suspension system according to claim 1, wherein the bladder is operative to be inflated with a gas, wherein the bladder is biased to the expanded position.

4. A personal water craft suspension system according to claim 3, wherein the bladder includes an upper and lower gasket surface, where the upper gasket surface is operative to form a first water tight seal with the seat, and wherein the lower gasket surface is operative to form a second water tight seal with the hull, wherein the first and second water tight seals are operative to prevent water from entering the personal water craft between the hull and the seat.

5. A personal water craft suspension system according to claim 4, as the bladder expands and compresses responsive to the seat moving up and down with respect to the hull, the bladder is operative to maintain the first and second water tight seals.

6. A personal water craft suspension system according to claim 1, further comprising a second telescopic connector, wherein the second telescopic is operative to further releaseably connect the seat to the hull.

7. A personal water craft suspension system according to claim 6, wherein the seat includes a rear portion and a front portion, wherein the first telescopic connector includes a locking head, wherein the locking head is operative to releaseably engage the rear portion of the seat, wherein the second telescopic connector includes a U hook portion, wherein the U hook portion is operative to releaseably engage the front portion of the seat.

8. A personal water craft suspension system according to claim 1, wherein the telescopic connector includes a locking head, wherein the locking head is operative to releaseably engage the seat.

9. A personal water craft suspension system according to claim 8, wherein the telescopic connector further includes a cylinder and a shaft, wherein the shaft is in reciprocating connection with the cylinder, wherein the shaft is biased to an extended position.

10. A personal water craft suspension system according to claim 9, wherein telescopic connector includes a spring that is operative to bias the shaft to the extended position.

11. A personal water craft suspension system according to claim 10, wherein the cylinder includes an external threaded portion that is operative to receive at least one nut for bolting the telescopic connector to the hull of the personal water craft.

12. A personal water craft suspension system according to claim 1, wherein the telescopic connector includes a U hook portion, wherein the U hook portion is operative to releaseably engage the seat, wherein when the telescopic connector is mounted to the hull, the U hook portion is biased to an extended position.

13. A personal water craft suspension system according to claim 12, wherein the U hook portion includes two parallel side portions, wherein each side portion includes a spring for biasing the U hook portion to the extended position.

14. A personal water craft suspension system according to claim 13, wherein the ends of each side portion are threaded, wherein when the side portions are positioned through holes in the hull, each threaded portion is operative to receive a nut for preventing the side portions from sliding out of the holes.

15. A personal water craft suspension system comprising:

a personal water craft, wherein the personal water craft includes a hull and a seat;

a telescopic latch in operative connection with the hull;

a telescopic U hook in operative connection with the hull; and a bladder positioned between the hull and the seat, wherein the seat is in removable connection with the telescopic latch and telescopic U hook, wherein the telescopic latch, telescopic U hook, and bladder are operative to compress and expand responsive to forces between the seat and the hull, whereby the bladder is operative to dampen the jarring effect of bumps and other vertical forces on a user sitting on the seat of the personal water craft.

16. A personal water craft suspension system according to claim 15, wherein the bladder is operative to form a water tight seal between the seat and the hull.

17. A personal water craft suspension system according to claim 16, wherein the telescopic latch and telescopic U hook are biased to an extended position.

18. A personal water craft suspension system according to claim 17, wherein the bladder is operative to be inflated with a gas.

* * * * *